US010496015B2

(12) United States Patent
Tanaka

(10) Patent No.: US 10,496,015 B2
(45) Date of Patent: Dec. 3, 2019

(54) TRANSFER DEVICE AND IMAGE FORMING APPARATUS

(71) Applicant: FUJI XEROX CO., LTD., Tokyo (JP)

(72) Inventor: Daisuke Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/803,841

(22) Filed: Nov. 6, 2017

(65) Prior Publication Data

US 2018/0203383 A1 Jul. 19, 2018

(30) Foreign Application Priority Data

Jan. 18, 2017 (JP) ..... 2017-006284

(51) Int. Cl.
*G03G 15/16* (2006.01)

(52) U.S. Cl.
CPC ..... *G03G 15/161* (2013.01)

(58) Field of Classification Search
None
See application file for complete search history.

(56) References Cited

U.S. PATENT DOCUMENTS 7,831,185 B2 * 11/2010 Masubuchi ..... G03G 15/0131 399/302
8,165,498 B2 4/2012 Hoshino et al.
8,718,500 B2 5/2014 Minbu et al.
2007/0269230 A1 * 11/2007 Hoshino ..... G03G 15/167 399/45
2011/0008080 A1 * 1/2011 Chiba ..... G03G 15/0131 399/304
2012/0008991 A1 * 1/2012 Shimizu ..... G03G 15/1675 399/297
2014/0072340 A1 * 3/2014 Kato ..... G03G 15/1605 399/121
2014/0112674 A1 * 4/2014 Toyama ..... G03G 15/1615 399/44

FOREIGN PATENT DOCUMENTS

JP 2009-058896 3/2009
JP 2010-204259 9/2010
JP 2011-186168 9/2011
JP 2013-072908 4/2013

* cited by examiner

*Primary Examiner* — Victor Verbitsky
(74) *Attorney, Agent, or Firm* — JCIPRNET

(57) ABSTRACT

A transfer device includes a first roller, a second roller that is disposed at a position facing the first roller in such a manner as to be freely movable in a direction in which the second roller comes into and out of contact with the first roller and that transfers a toner image onto a sheet, which has been transported, by nipping the sheet between the first roller and the second roller, and a controller that controls movement of the second roller in such a manner that, when a predetermined type of sheet is transported, a gap smaller than a thickness of the sheet is formed between the first roller and the second roller when a leading end of the sheet enters between the first roller and the second roller.

9 Claims, 4 Drawing Sheets

FIG. 2

| SHEET TRAY | TYPE OF SHEET |
|---|---|
| 31 | NORMAL SHEET |
| 32 | MEDIUM THICK SHEET |
| 33 | THICK SHEET |

TRANSFER DEVICE AND IMAGE FORMING APPARATUS

CROSS-REFERENCE TO RELATED APPLICATIONS

This application is based on and claims priority under 35 USC 119 from Japanese Patent Application No. 2017-006284 filed Jan. 18, 2017.

BACKGROUND

(i) Technical Field

The present invention relates to a transfer device and an image forming apparatus.

(ii) Related Art

A transfer device is known that causes a sheet that has been transported to pass through a transfer nip defined by two rotary members being in contact with each other and transfers a toner image onto the sheet by applying a transfer bias. In the transfer device, in the case where the contact pressure (nip pressure) between the two members is large, there is a possibility that the members will be pressed in a sheet-transport direction when the sheet enters the transfer nip, which in turn results in a change in the speed at which the members rotate, and as a result, an image quality defect will occur. In addition, there is a possibility that the members will vibrate as a result of receiving a force in a direction in which the members are pressed and the transfer nip is made to expand when the sheet enters the transfer nip, and also this vibration will cause an image quality defect.

SUMMARY

According to an aspect of the invention, there is provided a transfer device including a second roller that is disposed at a position facing the first roller in such a manner as to be freely movable in a direction in which the second roller comes into and out of contact with the first roller and that transfers a toner image onto a sheet, which has been transported, by nipping the sheet between the first roller and the second roller, and a controller that controls movement of the second roller in such a manner that, when a predetermined type of sheet is transported, a gap smaller than a thickness of the sheet is formed between the first roller and the second roller when a leading end of the sheet enters between the first roller and the second roller.

BRIEF DESCRIPTION OF THE DRAWINGS

Exemplary embodiments of the present invention will be described in detail based on the following figures, wherein:

FIG. 2 is a correspondence table of sheet trays and sheets accommodated in the sheet trays;

DETAILED DESCRIPTION

Exemplary embodiments of the present invention will be described below.

Figure 1:
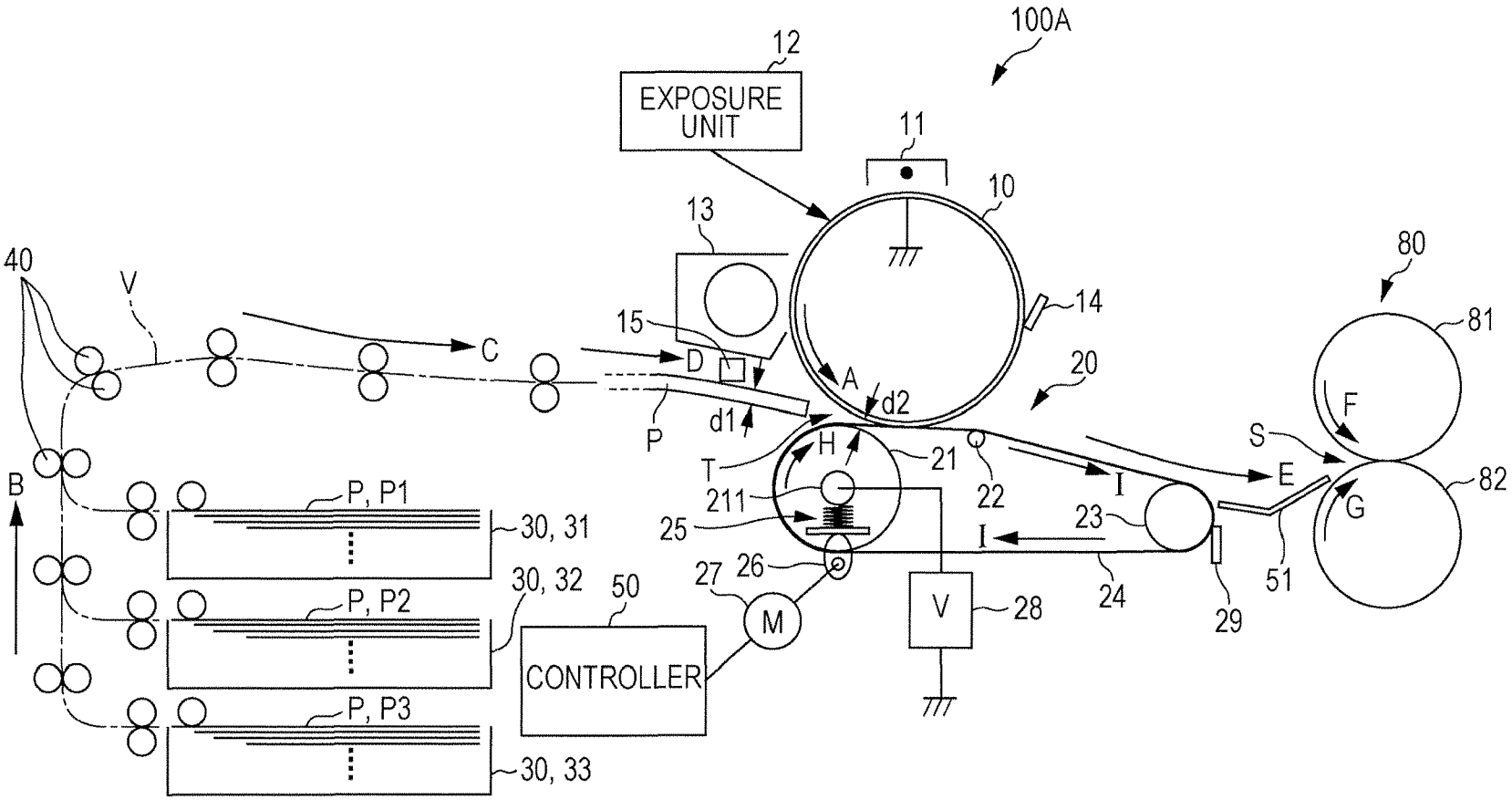
FIG. 1 is a schematic diagram of an image forming apparatus according to a first exemplary embodiment of the present invention.

FIG. 1 is a schematic diagram of an image forming apparatus according to a first exemplary embodiment of the present invention. The image forming apparatus illustrated in FIG. 1 includes a transfer device according to the first exemplary embodiment of the present invention.

An image forming apparatus 100A includes a photoconductor drum 10. The photoconductor drum 10 corresponds to an example of a first roller according to the first exemplary embodiment of the present invention. The photoconductor drum 10 is rotatably supported on a frame (not illustrated) and rotates in the direction of arrow A. A charger 11, an exposure unit 12, and a developing unit 13 are disposed around the photoconductor drum 10. A toner image is formed on the photoconductor drum 10 through processes of charging, light exposure, and development, and the toner image is temporarily carried on the photoconductor drum 10.

The image forming apparatus 100A further includes three sheet trays 30 that are mounted in such a manner as to be capable of being drawn out. Sheets P are stacked on top of one another in the sheet trays 30.

One of the sheets P stacked on top of one another in the specified sheet tray 30 among the three sheet trays 30 is taken out from the specified sheet tray 30 and transported by sheet-transport members 40 along a sheet transport path W in the directions of arrows B, C, and D.

One of the sheets P that has been transported in the direction of arrow D enters a transfer region T defined by the photoconductor drum 10 and a transfer device 20, which will be described later. During the period when the sheet P is passing through the transfer region T, a toner image on the photoconductor drum 10 is transferred onto the sheet P. The sheet P to which the toner image has been transferred is further transported in the direction of arrow E and sent into a fixing device 80. The fixing device 80 includes a heating roller 81 that rotates in the direction of arrow F and a pressure roller 82 that rotates in the direction of arrow G. The heating roller 81 and the pressure roller 82 define a fixing region S by being in contact with each other.

The sheet P that has been transported in the direction of arrow E enters the fixing region S and is heated and pressurized during the period when the sheet P is passing through the fixing region S, and as a result, the toner image on the sheet P is fixed onto the sheet P.

Toner that remains on the photoconductor drum 10 after the toner image has been transferred to the sheet P in the transfer region T is removed from the photoconductor drum 10 by a cleaner 14.

The transfer device 20 includes a transfer roller 21, a pressing roller 22, a separation roller 23, and an endless transfer belt 24 that are stretched by these rollers.

The transfer roller 21 is supported on the frame (not illustrated) in such a manner as to be rotatable and movable in the direction in which the transfer roller 21 moves toward and away from the photoconductor drum 10. The transfer roller 21 corresponds to an example of a second roller according to the first exemplary embodiment of the present invention. The pressing roller 22 and the separation roller 23 are rotatably supported on the frame (not illustrated).

The transfer roller 21 has a structure in which a rotary shaft 211 thereof is raised via a spring member 25 as a result of rotation of a cam member 26. The cam member 26 is coupled to a motor 27 and rotates by rotational operation of the motor 27. A combination of the spring member 25, the cam member 26, and the motor 27 corresponds to an example of a constant-load control unit according to the first exemplary embodiment of the present invention. The rotary shaft 211 of the transfer roller 21 is connected to a constant-current power supply 28 that applies a transfer bias between the transfer roller 21 and the photoconductor drum 10 that is grounded. The constant-current power supply 28 corresponds to an example of a constant-current power supply according to the first exemplary embodiment of the present invention.

The transfer roller 21 is formed of an elastic roller having an elastically deformable roller surface and drives the transfer belt 24 by rotating in the direction of arrow H. The transfer belt 24 moves circularly in the direction of arrow I as a result of receiving the driving force. The transfer belt 24 corresponds to an example of a belt member according to the first exemplary embodiment of the present invention. The pressing roller 22 and the separation roller 23 are driven and rotated by the transfer belt 24 moving circularly.

The transfer roller 21 is positioned further upstream than the rotation center axis of the photoconductor drum 10 in a sheet-transport direction. In contrast, the pressing roller 22 is positioned further downstream than the rotation center axis of the photoconductor drum 10 in the sheet-transport direction and presses the transfer belt 24 against the photoconductor drum 10 from a space enclosed by the transfer belt 24. The transfer roller 21 is freely movable in the vertical direction in which the transfer roller 21 moves toward and away from the photoconductor drum 10, and there is a case where a gap is formed between the photoconductor drum 10 and the transfer roller 21 as a result of the transfer roller 21 being lowered. Even in this case, the pressing roller 22 pushes up the transfer belt 24, and thus, the transfer belt 24 is in contact both with the transfer roller 21 and the photoconductor drum 10.

The separation roller 23 is a roller having a diameter smaller than that of the transfer roller 21, and the direction of movement of the transfer belt 24 is sharply changed by the separation roller 23, so that a leading end of one of the sheets P, the sheet P being located on the transfer belt 24, is separated from the transfer belt 24. The sheet P that has been separated from the transfer belt 24 is guided by a guiding member 51 so as to be transported in the direction of arrow E and passes through the fixing region S of the fixing device 80 as described above. During the period when the sheet P is passing through the fixing region S, a toner image on the sheet P is fixed onto the sheet P, and an image formed of the fixed toner image is formed on the sheet P. The sheet P on which the image has been formed is sent out to a sheet ejection tray (not illustrated) that is provided so as to be located outside the image forming apparatus 100A.

The transfer device 20 includes a cleaner 29. Toner and other contaminants deposited on the transfer belt 24 are removed from the transfer belt 24 by the cleaner 29.

The image forming apparatus 100A further includes a controller 50. The controller 50 controls the operation of each unit of the image forming apparatus 100A. As part of the control, the controller 50 also performs control of the motor 27 that causes the cam member 26 to rotate and control of the constant-current power supply 28. The controller 50 corresponds to an example of a controller according to the first exemplary embodiment of the present invention.

The operation of transferring a toner image formed on the photoconductor drum 10 onto one of the sheets P will now be described in further detail.

FIG. 2 is a correspondence table of sheet trays and sheets accommodated in the sheet trays.

The image forming apparatus 100A has a function of setting beforehand the thicknesses of the sheets P to be accommodated in the sheet trays 30. The set correspondence table of sheet trays 31, 32, and 33 and sheets P1, P2, and P3 is stored in the controller 50.

As an example, as illustrated in FIG. 2, normal sheets P1 are accommodated in the sheet tray 31 that is the uppermost sheet tray among the three sheet trays 30, and medium thick sheets P2 each having a thickness larger than that of each of the normal sheets P1 are accommodated in the sheet tray 32 positioned in the middle. Thick sheets P3 each having a thickness larger than that of each of the medium thick sheets P2 are accommodated in the lowermost sheet tray 33. When image formation is performed, a user specifies one of the sheet trays 30 from which one of the sheets P to be used in the image formation is taken out. This enables the image forming apparatus 100A to identify which one of the sheets P having different thicknesses is to be used in the image formation.

Here, a case will now be described in which the transfer roller 21 is pressed toward the photoconductor drum 10 with the transfer belt 24 interposed therebetween before one of the sheets P taken out from one of the sheet trays 30 enters the transfer region T. In this case, when the sheet P that has been transported enters the transfer region T, the transfer roller 21 and the photoconductor drum 10 are pressed such that a gap having a width equal to the thickness of the sheet P entering the transfer region T is formed between the transfer roller 21 and the photoconductor drum 10. Since the transfer roller 21 is raised via the spring member 25, constant-load control is performed. In contrast, the photoconductor drum 10 is rigidly and rotatably fixed to the frame (not illustrated) in such a manner that neither a change in the position of the photoconductor drum 10 nor vibration of the photoconductor drum 10 will occur, and in terms of a spring, the photoconductor drum 10 has a spring constant much larger than the spring constant of the spring member 25 on the side on which the transfer roller 21 is disposed. Thus, most of the force generated by the sheet P entering the transfer region T, the force pressing the transfer roller 21 and the photoconductor drum 10 such that the gap is formed between the transfer roller 21 and the photoconductor drum 10, is absorbed by the transfer roller 21. However, in the case where the sheet P that has entered the transfer region T is a thick sheet, the force generated by the sheet P suddenly entering the transfer region T is not completely accommodated only by the transfer roller 21, and consequently, the photoconductor drum 10, which is strongly fixed to the frame and which has a large spring constant in terms of a spring, is caused to vibrate. When the photoconductor drum 10 vibrates, the distance between the exposure unit 12 and the photoconductor drum 10 changes, and there is a possibility that image irregularities will occur in an electrostatic latent image to be formed on the photoconductor drum 10 and eventually that the image quality of an image to be formed on the sheet P will deteriorate.

A case will now be described in which the transfer roller 21 is separated from the photoconductor drum 10 by a distance larger than the thickness of one of the sheets P before the sheet P enters the transfer region T. In this case, when the sheet P, which has been transported, enters the transfer region T, the photoconductor drum 10 does not vibrate. However, the transfer roller 21 is to be pushed up after the sheet P has entered the transfer region T in such a manner that the sheet P is pressed against the photoconductor drum 10, and if an image has been formed also on a leading end portion of the sheet P entering the transfer region T, even though the transfer roller 21 is pushed up after the sheet P has entered the transfer region T, there is a possibility that irregularities or missing portions will occur in the image formed on the leading end portion of the sheet P due to a transfer failure.

Accordingly, in the first exemplary embodiment, the position of the transfer roller 21 in the vertical direction when one of the sheets P that has been transported enters the transfer region T is controlled. More specifically, in the case where one of the sheets P (normal sheets P1) is taken out from the sheet tray 31, in which the normal sheets P1 are accommodated, and where an image is formed on the sheet (normal sheet P1), the transfer roller 21 is pressed beforehand toward the photoconductor drum 10 with the transfer belt 24 therebetween. This is because, in the case of the normal sheet P1, the sheet thickness of the normal sheet P1 is small, and thus, vibration that causes deterioration of image quality will not occur in the photoconductor drum 10 even if the normal sheet P1 enters the transfer region T in a state where the transfer roller 21 is pressed toward the photoconductor drum 10. In contrast, in the case where one of the sheets P (medium thick sheets P2) is taken out from the sheet tray 32, in which the medium thick sheets P2 are accommodated, and where an image is formed on the sheet P (medium thick sheet P2), and in the case where one of the sheets P (thick sheets P3) is taken out from the sheet tray 33, in which the thick sheets P3 are accommodated, and where an image is formed on the sheet P (thick sheet P3), a gap (a space as an air space excluding the thickness of the transfer belt 24) is formed between the photoconductor drum 10 and the transfer roller 21 before the sheet P (medium thick sheet P2 or thick sheet P3) enters the transfer region T. However, if the gap is too large, there is a possibility that irregularities or missing portions will occur in an image formed on a leading end portion of the sheet P, and thus, the gap is set to be smaller than the thickness of the sheet P (medium thick sheet P2 or thick sheet P3) that enters the transfer region T. In addition, the width of the gap is set in accordance with the thickness of the sheet P that enters the transfer region T. In other words, when the medium thick sheet P2 enters the transfer region T, the gap is set to be smaller than the sheet thickness of the medium thick sheet P2 and to be larger than that in the case where the thick sheet P3 enters the transfer region T. When the thick sheet P3 enters the transfer region T, the gap is set to be smaller than the thickness of the thick sheet P3 and to be smaller than that in the case where the medium thick sheet P2 enters the transfer region T. After the medium thick sheet P2 or the thick sheet P3 has approached the transfer region T, and then the leading end portion of the sheet P (medium thick sheet P2 or thick sheet P3) has entered the transfer region T and has been located at a position where the width dimension of the gap is equal to the thickness dimension of the sheet P, the transfer roller 21 is strongly pressed toward the photoconductor drum 10 by being pushed up with a force larger than that when the leading end portion of the sheet P has entered the transfer region T and has been located at the position. This enhances a force that transports the sheet P. In the case of a sheet that is long in the sheet-transport direction, there is a case where an operation of transferring a toner image onto the sheet has not yet been completed when the leading end of the sheet enters the fixing region S. When a force that transports the sheet is small, that is, when the transfer roller 21 is not sufficiently strongly pressed toward the photoconductor drum 10, there is a possibility that an impact generated as a result of the leading end of the sheet entering the fixing region S will be transmitted to the transfer region T and will interfere with the operation of transferring the toner image onto the sheet. In the first exemplary embodiment, since the transfer roller 21 is strongly pressed toward the photoconductor drum 10 by being pushed up after one of the sheets P has entered the transfer region T, interference with a transfer operation is prevented even in the above-described situation.

Figure 3A:
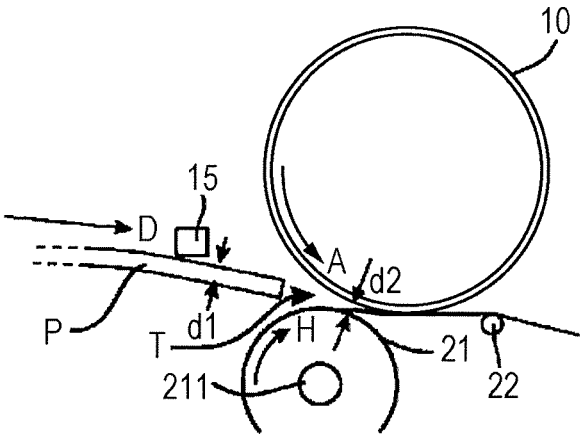
FIGS. 3A and 3B are schematic diagrams illustrating states before and after a sheet enters a transfer region.
Figure 3B:
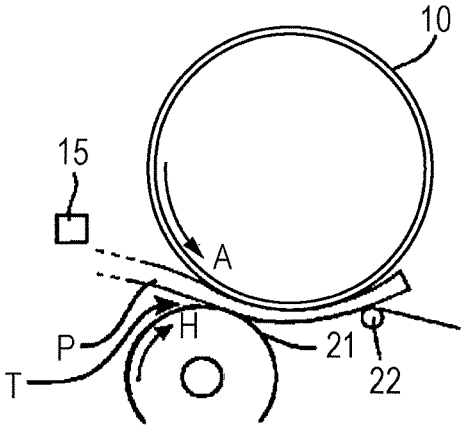

FIGS. 3A and 3B are schematic diagrams illustrating states before and after a sheet that is a medium thick sheet or a thick sheet enters a transfer region. FIG. 3A illustrates a state immediately before the sheet enters the transfer region, and FIG. 3B illustrates a state after the sheet has entered the transfer region.

The image forming apparatus 100A according to the first exemplary embodiment includes a sheet-leading-end detection sensor 15 that is positioned further upstream than the transfer region T in the sheet-transport direction. In the first exemplary embodiment, before one of the sheets P is taken out from one of the sheet trays 30, the transfer roller 21 is in a state of being sufficiently spaced apart from the photoconductor drum 10 regardless of the type of the sheet P. After the sheet P has been taken out from the sheet tray 30, and the leading end of the sheet P has been detected by the sheet-leading-end detection sensor 15, the motor 27 starts rotating in response to a command from the controller 50, and the transfer roller 21 is pushed up by the cam member 26 via the spring member 25. In the case where the sheet P that has been taken out is one of the normal sheets P1, the transfer roller 21 is pressed toward the photoconductor drum 10 before the leading end of the normal sheet P1 enters the transfer region T. In the case where the sheet P that has been taken out is one of the medium thick sheets P2, the controller 50 measures a predetermined period of time by using, as a trigger, the fact that the leading end of the medium thick sheet P2 has been detected by the sheet-leading-end detection sensor 15, and the controller 50 causes the motor 27 to rotate after the predetermined period of time has passed. By adjusting beforehand the time taken for the motor 27 to start rotating, a gap d2 (see FIG. 3A) that is smaller than the thickness d1 of the medium thick sheet P2 is formed when the medium thick sheet P2 enters the transfer region T. The motor 27 keeps rotating after the medium thick sheet P2 has entered the transfer region T, and the transfer roller 21 is pushed up to a predetermined position.

In the case where the sheet P that has been taken out is one of the thick sheets P3, an operation similar to that in the case of the medium thick sheet P2 is performed. In other words, in the case where the sheet P that has been taken out is one of the thick sheets P3, the controller 50 measures a predetermined period of time by using, as a trigger, the fact that the leading end of the thick sheet P3 has been detected by the sheet-leading-end detection sensor 15, and the controller 50 causes the motor 27 to rotate after the predetermined period of time has passed. However, in the case of the thick sheet P3, the motor 27 is caused to rotate after a period of time longer than that in the case of the medium thick sheet P2 has passed. By adjusting beforehand the time taken for the motor 27 to start rotating, the gap d2 (see FIG. 3A) that is smaller than the thickness d1 of the thick sheet P3 is formed when the thick sheet P3 enters the transfer region T. The motor 27 keeps rotating after the thick sheet P3 has entered the transfer region T, and the transfer roller 21 is pushed up to a predetermined position.

Even in the case where a gap is formed between the photoconductor drum 10 and the transfer roller 21 before one of the sheets P enters the transfer region T, the transfer belt 24 is in contact both with the transfer roller 21 and the photoconductor drum 10. If the transfer belt 24 is not provided, electric discharge occurs between the transfer roller 21 and the photoconductor drum 10 due to the transfer bias, and there is a possibility that image irregularities will occur in a toner image on the photoconductor drum 10 due to the electric discharge, which in turn results in deterioration of image quality. In the first exemplary embodiment, since the transfer belt 24 is provided so as to be in contact both with the transfer roller 21 and the photoconductor drum 10, a current flows through the transfer belt 24, so that electric discharge is prevented, and consequently, deterioration of image quality due to electric discharge is prevented.

The impedance between the transfer roller 21 and the photoconductor drum 10 significantly differs between a state in which a gap has been formed between the transfer roller 21 and the photoconductor drum 10 before one of the sheets P enters the transfer region T, a state in which the sheet P has entered the transfer region T, and a state in which the transfer roller 21 has been further pushed up after the sheet P has entered the transfer region T. In the first exemplary embodiment, since the constant-current power supply 28 is employed as a power supply that applies the transfer bias, a favorable transfer operation is achieved by effectively keeping abreast of changes in the impedance.

Figure 4:
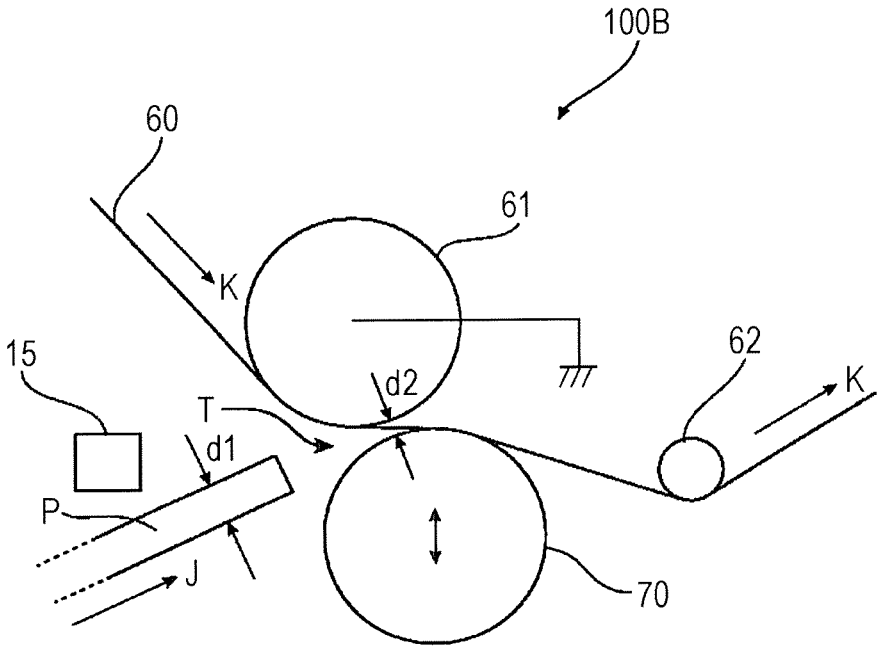
FIG. 4 is a schematic diagram illustrating a characteristic portion of an image forming apparatus according to a second exemplary embodiment of the present invention.

FIG. 4 is a schematic diagram illustrating a characteristic portion of an image forming apparatus according to a second exemplary embodiment of the present invention.

An image forming apparatus 100B includes an intermediate transfer belt 60. The intermediate transfer belt 60 is an endless belt and moves circularly in the direction of arrow K. Toner images formed of toners of different colors on plural photoconductor drums (not illustrated) are sequentially transferred onto the intermediate transfer belt 60 in such a manner as to be superposed on one another. The intermediate transfer belt 60 moves in the direction of arrow K while carrying a color toner image that is formed through this transfer operation and transports the toner image to the transfer region T. A backup roller 61 that is disposed in a space enclosed by the intermediate transfer belt 60 and a transfer roller 70 that is disposed on the front side of the intermediate transfer belt 60 are provided in the transfer region T, and the backup roller 61 and the transfer roller 70 face each other with the intermediate transfer belt 60 interposed therebetween. The backup roller 61 is constantly in contact with the intermediate transfer belt 60. The transfer roller 70 is freely movable in the vertical direction in which the transfer roller 70 moves toward and away from the backup roller 61, and similar to the transfer roller 21 illustrated in FIG. 1, the transfer roller 70 is configured to be pushed up via a spring member that is not illustrated in FIG. 4. In addition, similar to the transfer roller 21 illustrated in FIG. 1, the transfer roller 70 is applied with a transfer bias by a constant-current power supply.

A pressing roller 62 is disposed in the space enclosed by the intermediate transfer belt 60 so as to be positioned further downstream than the backup roller 61 in a direction of movement of the intermediate transfer belt 60 (the direction of arrow K). The pressing roller 62 presses down the intermediate transfer belt 60 in such a manner that the intermediate transfer belt 60 is in contact with the transfer roller 70 even in a state in which a gap is formed between the backup roller 61 and the transfer roller 70 as a result of the transfer roller 70 moving downward.

In the image forming apparatus 100B according to the second exemplary embodiment, at first, the transfer roller 70 is located at a sufficiently lowered position and forms a gap larger than the thickness of a thick sheet between the transfer roller 70 and the backup roller 61. Then, the transfer roller 70 starts moving upward in accordance with the type of one of the sheets P immediately after the sheet-leading-end detection sensor 15 has detected the leading end of the sheet P or after a predetermined period of time has passed. At least in the case where the sheet P that enters the transfer region T is a thick sheet, a gap smaller than the thickness of the sheet P is formed in accordance with the thickness of the sheet P when the sheet P enters the transfer region T. The transfer roller 70 is further pushed up after the sheet P has entered the transfer region T.

As described above, the present invention may also be applied to an image forming apparatus that includes an intermediate transfer body.

Note that, although a case has been described in which, only for some types of sheets, a gap smaller than the thickness of each of the sheets is formed, a gap smaller than the thickness of each sheet may be formed for all types of sheets.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a first roller;

a second roller that is disposed at a position facing the first roller in such a manner as to be freely movable in a direction in which the second roller comes into and out of contact with the first roller and that transfers a toner image onto a sheet, which has been transported, by nipping the sheet between the first roller and the second roller; and a controller that controls movement of the second roller in such a manner that, when a predetermined type of sheet is transported, and when a leading edge of the sheet enters between the first roller and the second roller, a gap is defined as a shortest distance between a circumferential surface of the first roller and a circumferential surface of the second roller, and the gap is greater than a thickness of a belt member interposed between the first roller and the second roller and is smaller than a thickness of the sheet, wherein the thickness of the sheet is greater than the thickness of the belt member.

2. The transfer device according to claim 1, wherein, after the leading end of the sheet has entered the gap, the controller causes the second roller to move in a direction in which the second roller comes closer to the first roller than the second roller is when the leading end of the sheet enters the gap.

3. The transfer device according to claim 1, wherein the controller controls movement of the second roller such that, when the leading end of the sheet that has been transported enters the gap, the gap is expanded in accordance with the thickness of the sheet in such a manner as to be smaller than the thickness of the sheet.

4. The transfer device according to claim 1, wherein the belt member is in contact with both the first roller and the second roller during a period in which the gap is formed between the first roller and the second roller.

5. The transfer device according to claim 1, further comprising:

a constant-current power supply that applies a constant-current bias between the first roller and the second roller.

6. The transfer device according to claim 1, further comprising:

a constant-load control unit that presses the second roller toward the first roller with a constant load.

7. An image forming apparatus comprising:

an image carrier that carries a toner image;

a transfer device that transfers the toner image on the image carrier onto a sheet;

a fixing device that fixes the toner image, which has been transferred to the sheet, onto the sheet; and a sheet transport unit that transports the sheet along a transport path passing through a transfer position at which the transfer device transfers the toner image onto the sheet and a fixing position at which the fixing device fixes the toner image on the sheet onto the sheet, wherein the transfer device includes a first roller;

a second roller that is disposed at a position facing the first roller in such a manner as to be freely movable in a direction in which the second roller comes into and out of contact with the first roller and that transfers a toner image onto a sheet, which has been transported, by nipping the sheet between the first roller and the second roller; and a controller that controls movement of the second roller in such a manner that, when a predetermined type of sheet is transported, and when a leading edge of the sheet enters between the first roller and the second roller, a gap is defined as a shortest distance between a circumferential surface of the first roller and a circumferential surface of the second roller, and the gap is greater than a thickness of a belt member interposed between the first roller and the second roller and is smaller than a thickness of the sheet, wherein the thickness of the sheet is greater than the thickness of the belt member.

8. A transfer device comprising:

a first roller;

a second roller that is disposed at a position facing the first roller in such a manner as to be freely movable in a direction in which the second roller comes into and out of contact with the first roller and that transfers a toner image onto a sheet, which has been transported, by nipping the sheet between the first roller and the second roller;

a belt member interposed between the first roller and the second roller;

a third roller, wherein a rotation center of the first roller is located further downstream than a rotation center of the second roller in a sheet-transport direction, a rotation center of the third roller is located further downstream than the rotation center of the first roller in the sheet-transport direction, the second roller and the third roller are in contact with a same surface of the belt member, the first roller is in contact with a surface of the belt member opposite the same surface; and a controller that controls movement of the second roller in such a manner that, when a predetermined type of sheet is transported, a gap smaller than a thickness of the sheet is formed between the first roller and the second roller when a leading end of the sheet enters between the first roller and the second roller, and wherein, when the gap is formed between the first roller and the second roller, the third roller pushes the belt member so the belt member is in contact with both the first roller and the second roller.

9. A transfer device comprising:

a first roller;

a second roller that is disposed at a position facing the first roller in such a manner as to be freely movable in a direction in which the second roller comes into and out of contact with the first roller and that transfers a toner image onto a sheet, which has been transported, by nipping the sheet between the first roller and the second roller;

a belt member interposed between the first roller and the second roller;

a third roller, wherein a rotation center of the second roller is located further downstream than a rotation center of the first roller in a sheet-transport direction, a rotation center of the third roller is located further downstream than the rotation center of the second roller in the sheet-transport direction, the first roller and the third roller are in contact with a same surface of the belt member, the second roller is in contact with a surface of the belt member opposite the same surface; and a controller that controls movement of the second roller in such a manner that, when a predetermined type of sheet is transported, a gap smaller than a thickness of the sheet is formed between the first roller and the second roller when a leading end of the sheet enters between the first roller and the second roller, and wherein, when the gap is formed between the first roller and the second roller, the third roller pushes the belt member so the belt member is in contact with both the first roller and the second roller.

* * * * *